US010127899B2

(12) United States Patent
Perez

(10) Patent No.: US 10,127,899 B2
(45) Date of Patent: Nov. 13, 2018

(54) SYSTEM AND METHOD TO INTERFACE AND CONTROL MULTIPLE MUSICAL INSTRUMENT EFFECTS MODULES AND PEDALS ON A COMMON PLATFORM

(71) Applicant: John A. Perez, Chandler, AZ (US)

(72) Inventor: John A. Perez, Chandler, AZ (US)

( * ) Notice: Subject to any disclaimer, the term of this patent is extended or adjusted under 35 U.S.C. 154(b) by 0 days.

(21) Appl. No.: 15/913,489

(22) Filed: Mar. 6, 2018

(65) Prior Publication Data

US 2018/0197512 A1 Jul. 12, 2018

Related U.S. Application Data

(63) Continuation-in-part of application No. 15/650,883, filed on Jul. 15, 2017, now abandoned, which is a continuation of application No. 15/091,232, filed on Apr. 5, 2016, now Pat. No. 9,728,172.

(51) Int. Cl.

| | |
|---|---|
| ***G10H 1/00*** | (2006.01) |
| ***G10H 1/18*** | (2006.01) |
| ***G10H 1/043*** | (2006.01) |
| ***G10H 1/34*** | (2006.01) |

(52) U.S. Cl.

CPC ..... *G10H 1/18* (2013.01); *G10H 1/043* (2013.01); *G10H 1/348* (2013.01); *G10H 2220/116* (2013.01); *G10H 2240/161* (2013.01); *G10H 2240/211* (2013.01)

(58) Field of Classification Search

CPC ..... G10H 1/18; G10H 1/043; G10H 1/348; G10H 2220/116; G10H 2240/161; G10H 2240/211

USPC ..... 84/615

See application file for complete search history.

(56) References Cited

U.S. PATENT DOCUMENTS

| | | | | |
|---|---|---|---|---|
| 4,479,238 | A | 10/1984 | Spector | |
| 6,215,055 | B1 * | 4/2001 | Saravis | G10H 1/348 84/422.1 |
| 7,005,571 | B1 * | 2/2006 | Groff | G10H 1/0066 84/615 |

(Continued)

*Primary Examiner* — Jeffrey Donels

(74) *Attorney, Agent, or Firm* — Inventive Law Inc.; Jim H. Salter

(57) ABSTRACT

A system and method for interfacing and controlling multiple musical instrument effects modules and pedals on a common platform. The system includes: a system processor; a backplane coupled with the system processor; a plurality of musical instrument effects modules removably inserted into the backplane, a plurality of musical instrument effects pedals removably inserted into the backplane via looper channels, each of the plurality of musical instrument effects modules and pedals including an audio input signal interface and an audio output signal interface, at least one of the musical instrument effects modules including a programmable potentiometer and/or programmable switch to modify an audio output signal; and a user interface configured to enable a user to apply a desired setting on the programmable potentiometer of the musical instrument effects modules via the system processor and the backplane: and a user interface configured to enable a user to reorder the musical effects signal path by dragging and dropping a module or pedal icon to a desired position among a plurality of icons thus electrically reordering the effects signal path.

21 Claims, 13 Drawing Sheets

(56) References Cited

U.S. PATENT DOCUMENTS

| | | | | |
|---|---|---|---|---|
| 7,373,210 | B2 * | 5/2008 | Pennock | G10H 1/02 381/118 |
| 7,525,038 | B2 * | 4/2009 | Yamada | G10H 1/0091 84/622 |
| 8,166,397 | B2 | 4/2012 | Quandt | |
| 8,642,870 | B1 * | 2/2014 | Rosa | A47G 27/0212 84/453 |
| 8,916,761 | B2 | 12/2014 | Robertson | |
| 9,620,094 | B2 * | 4/2017 | Abbate | G10H 1/348 |
| 9,728,172 | B1 | 8/2017 | Perez | |
| 2010/0229710 | A1 * | 9/2010 | Schoewer | G10H 1/0066 84/701 |
| 2010/0269670 | A1 * | 10/2010 | O'Connor | G10H 1/0091 84/626 |
| 2011/0271821 | A1 * | 11/2011 | McKinney | G10H 1/348 84/746 |
| 2013/0118340 | A1 | 5/2013 | D'Amours | |
| 2013/0312588 | A1 * | 11/2013 | Orshan | G10H 1/0091 84/609 |
| 2013/0327201 | A1 * | 12/2013 | Urry | G10H 1/06 84/626 |
| 2014/0090546 | A1 * | 4/2014 | Ceccolini | G10H 1/02 84/626 |
| 2014/0205113 | A1 | 7/2014 | Slipp | |
| 2015/0262566 | A1 * | 9/2015 | Ceccolini | G10H 1/348 84/746 |
| 2016/0019877 | A1 * | 1/2016 | Remignanti | G10H 1/0066 84/645 |
| 2016/0063976 | A1 * | 3/2016 | Wilk | G10H 1/055 84/626 |
| 2016/0258574 | A1 * | 9/2016 | Abbate | G10H 1/32 |
| 2016/0293151 | A1 * | 10/2016 | Mayo | G10H 1/0058 |
| 2017/0167931 | A1 * | 6/2017 | McMillen | G01L 5/225 |
| 2017/0206879 | A1 * | 7/2017 | Fiden | G10H 1/348 |

* cited by examiner

SYSTEM AND METHOD TO INTERFACE AND CONTROL MULTIPLE MUSICAL INSTRUMENT EFFECTS MODULES AND PEDALS ON A COMMON PLATFORM

REFERENCE TO PRIORITY PATENT APPLICATIONS

The present application is a continuation-in-part (CIP) patent application claiming priority to U.S. patent application Ser. No. 15/650,883, filed on Jul. 15, 2017, which is a continuation patent application of Ser. No. 15/091,232, filed on Apr. 5, 2016. This non-provisional CIP patent application claims priority to the referenced patent applications. The entire disclosure of the referenced patent applications is considered part of the disclosure of the present application and is hereby incorporated by reference herein in its entirety.

TECHNICAL FIELD

Embodiments of the disclosure relate generally to the field of musical instrument effects pedal devices. Embodiments relate more particularly to a system and method for interfacing and controlling multiple musical instrument effects pedals and modules on a common platform.

BACKGROUND

The industry that manufactures musical instrument effects pedals for performing musicians has used a common product format throughout much of its history. A typical effects pedal has a ¼" phone jack input on the right, a ¼" phone jack output on the left, is powered by 9V DC from either a wall mounted power source or a battery, potentiometers and switches for the musician to adjust the desired effect and a large foot switch for the musician to either switch the desired effect on or off while performing. Throughout the industry, these pedals share compatible electrical characteristics, such as input impedance, output impedance, input voltage level sensitivity for adequate signal processing, and output voltage levels suitable for driving the next effects pedal or musical instrument amplifier in the signal chain. FIG. 1 illustrates the main components of a typical musical instrument effects pedal.

Effects pedals come with any number of potentiometers, switches and LED's to provide the user a variety of effects modifications and indications of particular effects currently selected. A large foot switch on the pedal allows the musician to either select the pedal for the desired effect or bypass the pedal effectively connecting the signal input to the output with no change to the signal having passed through the pedal. Because virtually all effects pedals share these common features, musicians are able to choose effects pedals from a variety of different effects pedal manufactures to achieve the desired musical tone of their particular guitar, bass or other musical instrument. Any number of pedals can be combined from one to several dozen or more. FIG. 2 illustrates a typical configuration for a set of musical instrument effects pedals a musician has chosen for his or her particular musical instrument effects requirements. In this example, only three musical instrument effects pedals are shown to illustrate the intent, but any number of pedals is possible.

There are thousands of different pedals from hundreds of different manufactures to choose from and they are electrically input and output compatible. This variety of different pedals also has another common feature in that they typically have potentiometers and switches that must be manually adjusted to change the desired effect. If a musician wishes to change an effect during a song, he or she must stop playing and reach down to turn a potentiometer or change a switch setting, which is impractical for a live performance. Often the effect on the analog signal is very sensitive to the position of the potentiometer; so, it is very difficult to achieve the effect quickly and exact reproduction is limited to the players' patience. Most musicians simply set a particular pedal to a fixed effect and either switch it in or out of the signal path with a foot switch; hence, musical instrument effects pedals are often denoted by the term stomp box. The current method of manually adjusting potentiometers and toggling switches places restrictions on the user experience of achieving maximum tonal flexibility from any given pedal; so, most musicians simply set a stomp box to a particular effect and forget about changing it.

Thus far, the industry solution for improving the user experience of performing with a variety of effects pedals from various competing firms has been the introduction of the user configurable analog effects switch mounted on a pedal board along with the player's pedals. The effects switch takes the input and output from every effects pedal into an array of ¼" phone jacks and circuitry internal to the effects switch that can either bypass the effects pedal, place the effects pedal in the signal path, reconfigure the order of the effects pedals, or any combination of these actions. The various configurations are determined beforehand by the musician and programmed into the effects switch either by switches and a display on the effects switch or by the aid of a computer over an interface. Most of these user interfaces are cryptic and require patience to understand and time to gain proficiency. It is important to note that the effects switch does not modify the settings of the potentiometers or switches on the effects pedals plugged into it, including the footswitch. Effects pedals that are plugged into an effects switch must be enabled continuously for the effects switch to function. If an effects pedal is in the bypass state, there is no way for the effects switch to change its state to make the effects pedal useful. FIG. 3 depicts a typical configuration for an effects switch with several effects pedals. In addition to an effects switch, it is typical to have a common power supply for numerous effects pedals. Also, the addition of the power supply adds weight and consumes area that could otherwise be used for additional effects pedals.

SUMMARY

Example embodiments disclosed herein include a system and method for interfacing and controlling multiple musical instrument effects pedals and modules (which can be derived from musical instrument effects pedals) that can be new designs or existing designs having been modified by their manufacturer to interface onto a common platform. The example embodiments as disclosed herein allow manufacturers of musical instrument effects pedals (also referenced as stomp boxes inclusive of analog and/or digital effects circuitry) to redirect their current product lines from a simple isolated product with very limited control accessibility to a modular format that provides enhanced control and flexibility through a common modular digital interface under control of an embedded microprocessor and touch screen interface or a handheld device such as a mouse/trackball. These effects modules that are controlled by the system are used in conjunction with external pedals that are plugged into the system with external ¼" phone plugs.

Some of the objectives of the various example embodiments disclosed herein include the following:

1. Provide a system and method to automatically control the setting of any potentiometer in an effects module from one position to another in a repeatable fashion at the request of the musician through a remote footswitch or touch panel interface.
2. Provide a system and method to automatically control the setting of any switch in an effects module from one position to another in a repeatable fashion at the request of the musician through a remote footswitch or touch panel interface.
3. Provide a system and method to dynamically control the active or bypass state of an effects module or pedal at the request of the musician through a remote footswitch or touch panel interface.
4. Provide a system and method to dynamically reorder the inputs and outputs of any effects module or pedal with any other effects module or pedal at the request of the musician through a remote footswitch or touch panel interface.
5. Provide a system and method to automatically perform the actions of any of the above and in any combination to any number of effects modules or pedals through a remote footswitch or touch panel interface.
6. Provide a system and method to create and store in a memory file a list of effects module and pedal configurations and effects module and pedal ordering and then recall any of the configurations to reconfigure the effects modules or pedals from their current configuration to the recalled configuration through a remote footswitch or touch panel interface.
7. Significantly reduce the number of ¼" phone jack interface cables, wall mounted power supplies, the physical size, and the weight of an effects pedal system.
8. Significantly reduce the number of components, such as switches, power jacks, ¼" phone jack cables, potentiometers, knobs, and metal housings of a musical instrument effects pedal system.
9. Employ a touch panel display to configure the effects modules individually through touch selection of an effects module, which lead to setup screens for configuration, and then store these configuration settings in a file system controlled by the main processor.
10. Employ a Touch Screen Display (TSD) to allow the user to modify the order of the analog effects modules or pedals in the analog signal path into either a serial or parallel configuration by touching the icon of the respective module or pedal and dragging it to the desired location in the signal path and then releasing it. The reconfiguration of the TSD and the unit are automatic upon release of the icon.
11. Provide rapid reconfiguration of the entire analog effects system to a desired user defined preset configuration with one step of a single foot switch.
12. Provide stable, clean power to effects pedals that are connected to the unit and not require the user to rely on externally provided power from either wall mounted power supplies or third-party power supplies mounted to the pedal board.
13. Provide the capability for the system processor to utilize software defined waveforms and an analog CODEC combined with the ability to control an analog effects module configuration for the purpose of applying the waveform to the module input and sampling the module output at the CODEC for diagnostic purposes.
14. Provide access to a Wide-Area Data Network (WAN) from which the user can select configurations to upload and share or select shared configurations or data for download from sites such as social networks, web sites for module manufacturers, and other sources.
15. Provide access to the Wide-Area Data Network (WAN) from which the user can allow diagnostic and configuration information to be uploaded to a third party for maintenance and support activities.

BRIEF DESCRIPTION OF THE DRAWINGS

In the accompanying figures, similar reference numerals may refer to identical or functionally similar elements. These reference numerals are used in the detailed description to illustrate various embodiments and to explain various aspects and advantages of the present embodiments.

DETAILED DESCRIPTION

Example embodiments disclosed herein describe a system and method for interfacing and controlling multiple musical instrument effects modules and pedals on a common platform. The following detailed description is intended to provide example implementations to one of ordinary skill in the art, and is not intended to limit the invention to the explicit disclosure, as one or ordinary skill in the art will understand that variations can be substituted that are within the scope of the invention as described and claimed.

Terms Used Throughout this Document

Unit—The device, casing and housing described herein that contain all of the elements of the example embodiments with the exception of the external Configurable Switch Panel and Display. The terms unit, platform and system are used interchangeably.

Figure 1:
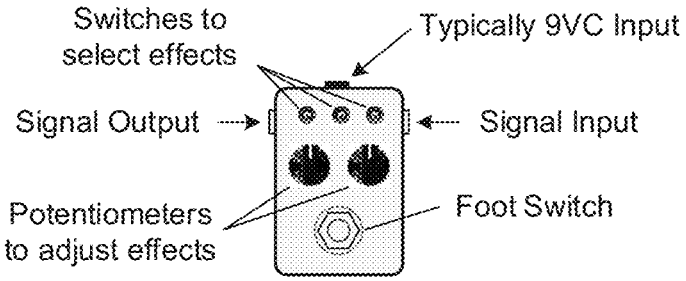
Fig. 1 (Prior Art)
FIG. 1 illustrates the main components of a typical musical instrument effects pedal.
Figure 2:
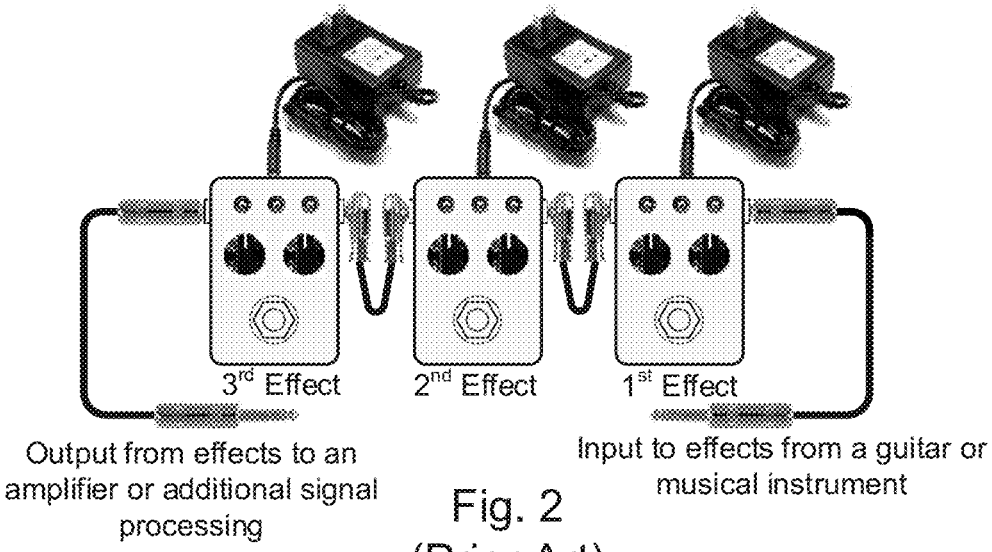
Fig. 2 (Prior Art)
FIG. 2 illustrates a typical configuration for a set of musical instrument effects pedals a musician has chosen for his or her particular musical instrument effects requirements.
Figure 3:
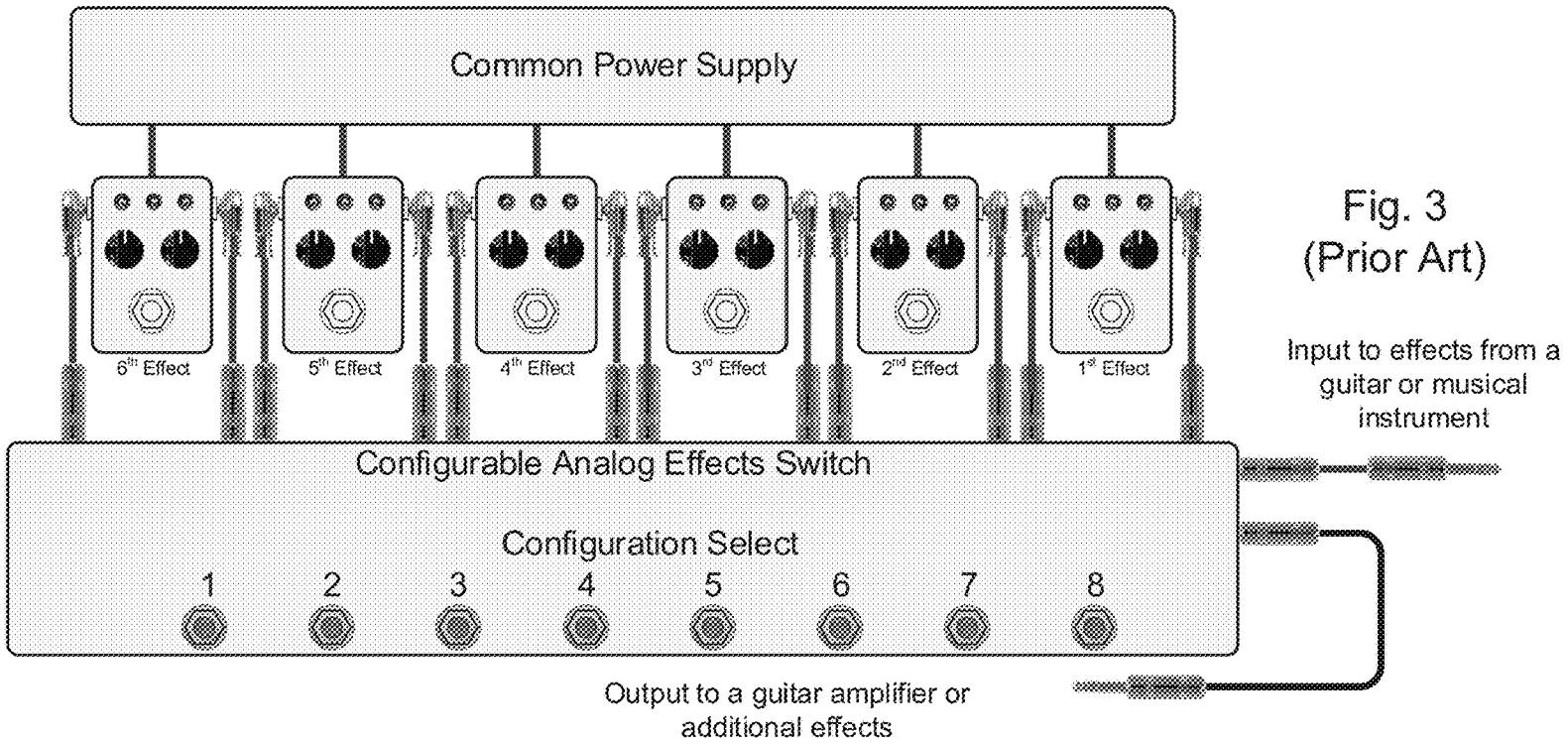
Fig. 3 (Prior Art)
FIG. 3 depicts a typical configuration for an analog effects switch with several effects pedals.

Effect(s) Pedal—an effects pedal, also referred to as a "stomp box" is a device such as that depicted in FIG. 1.

Effect(s) Module—a device that contains the signal processing circuitry of an effects pedal but is configured to fit into a slot in the unit and interface onto the system backplane.

Effects loop—also referred to as a loop or looper channel. An analog input and output path between a channel on the Cross-Point Switch (CPS) and an effects pedal. The analog input and output of the effects pedal is commonly connected to the unit with common ¼" phone jacks and the effects pedal can receive its power from the unit system power supply through a separate power interface.

Signal Path—The path of an analog signal from a guitar or other musical instrument from the input of the unit to the output of the unit. This path includes the inputs and outputs of the cross point switch and all effects modules, effects pedals or other electronic devices that are connected to the cross point switch analog inputs and outputs and have been selected by the player to alter the signal of the guitar or other musical instrument to their preference.

Active—The state of an effects pedal or module such that its signal conditioning circuitry is in the signal path.

Bypass—The state of an effects pedal or module such that its signal conditioning circuitry is not in the signal path. The input of the effects pedal or module has been connected to the output of the effects pedal or module in such a manner as to not alter the signal from input to output.

Pedal board—Typically a platform to mechanically host a variety of individual pedals in one convenient location for portability and player access. Components that typically populate an effects pedal board are a variety of pedals the player has chosen, a power supply for the pedals and an effects switch for controlling the order and active/bypass state of the pedals. A plethora of interface cable interconnects provides power and connects the analog inputs and outputs of these devices.

Acronyms Used Throughout This Document

CPS—Cross-Point Switch

CPSC—Cross-Point Switch Controller

Figure 4:
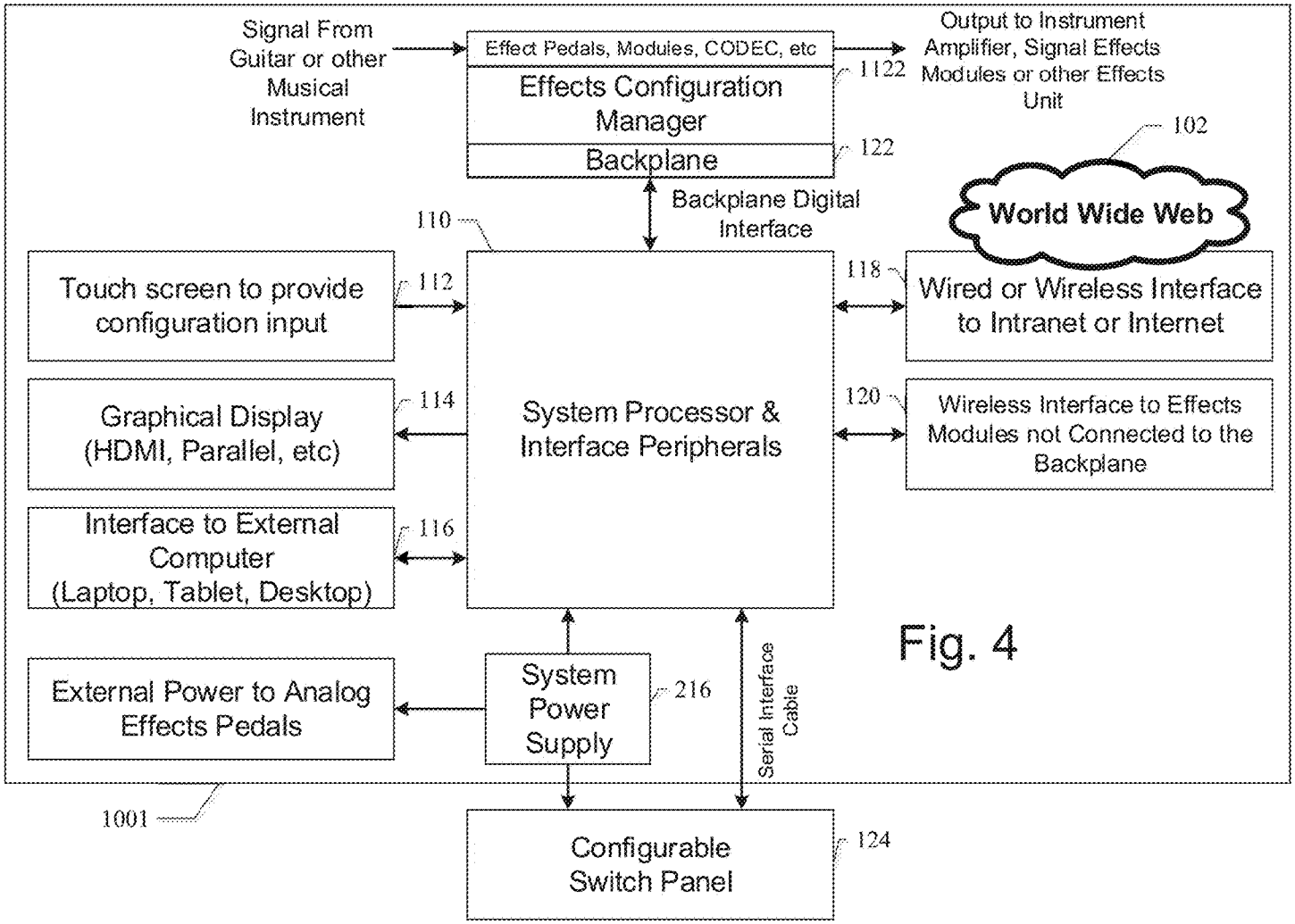
FIG. 4 illustrates a high-level view of the components of the platform or system of an example embodiment.

CSP—Configurable Switch Panel and Display either on the Unit or separate from the Unit IoT—Internet of Things ECM—Effects Configuration Manager MEC—Module Effects Controller MCI—Module Configuration Interface MPCI—Module Preset Control Interface SCM—System Configuration Manager TSD—Touch Screen Display System Overview FIG. 4 illustrates a high-level view of the components of the system of an example embodiment. All of the components depicted in FIG. 4 with the exception of the CSP 124 are contained in a single chassis called the unit or platform 1001. The unit 1001 contains a general purpose embedded processor system 110, an embedded graphical display 114 with touch screen 112 collectively known as the TSD 112/114, an interface 116 to an external computer, an interface 118 to an intranet or Wide-Area Data Network (WAN), such as the Internet, an interface to an external CSP 124, a backplane 122, which supports an interface to the ECM 1122 for the purpose of controlling the configuration of effects pedals 215 and modules 214, and a local wireless interface 120 to modules 214 and pedals 215 not connected to the backplane. System setup instructions for the CSP 124 and module 214 configurations are input to the system through a touch screen interface 112 or external computer 226. Once the system has been set up and configured, the module 214 configurations can be recalled from either the touch screen interface 112 or the CSP 124. A system power supply 216 provides all the required power supply voltages, power, and protection for the unit 1001, CSP 124 and externally connected effects pedals 215.

Effects pedals that have been modified into modular equivalents that are compatible with the backplane 122 interface are inserted and mechanically attached to the backplane 122 of the unit 1001. The modules 214 essential electrical design critical to the overall analog tonal aspect of the module 214 remain intact but have been adapted to fit onto a module 214 such that the switches and potentiometers are electrically configurable and can be controlled over the backplane 122 digital interface by the system processor 110. The backplane 122 interface can support and control any number of modules 214.

The disclosure below provides a more detailed description of the overall system, unit 1001, and the CSP 124.

System Description of an Example Embodiment

Figure 5:
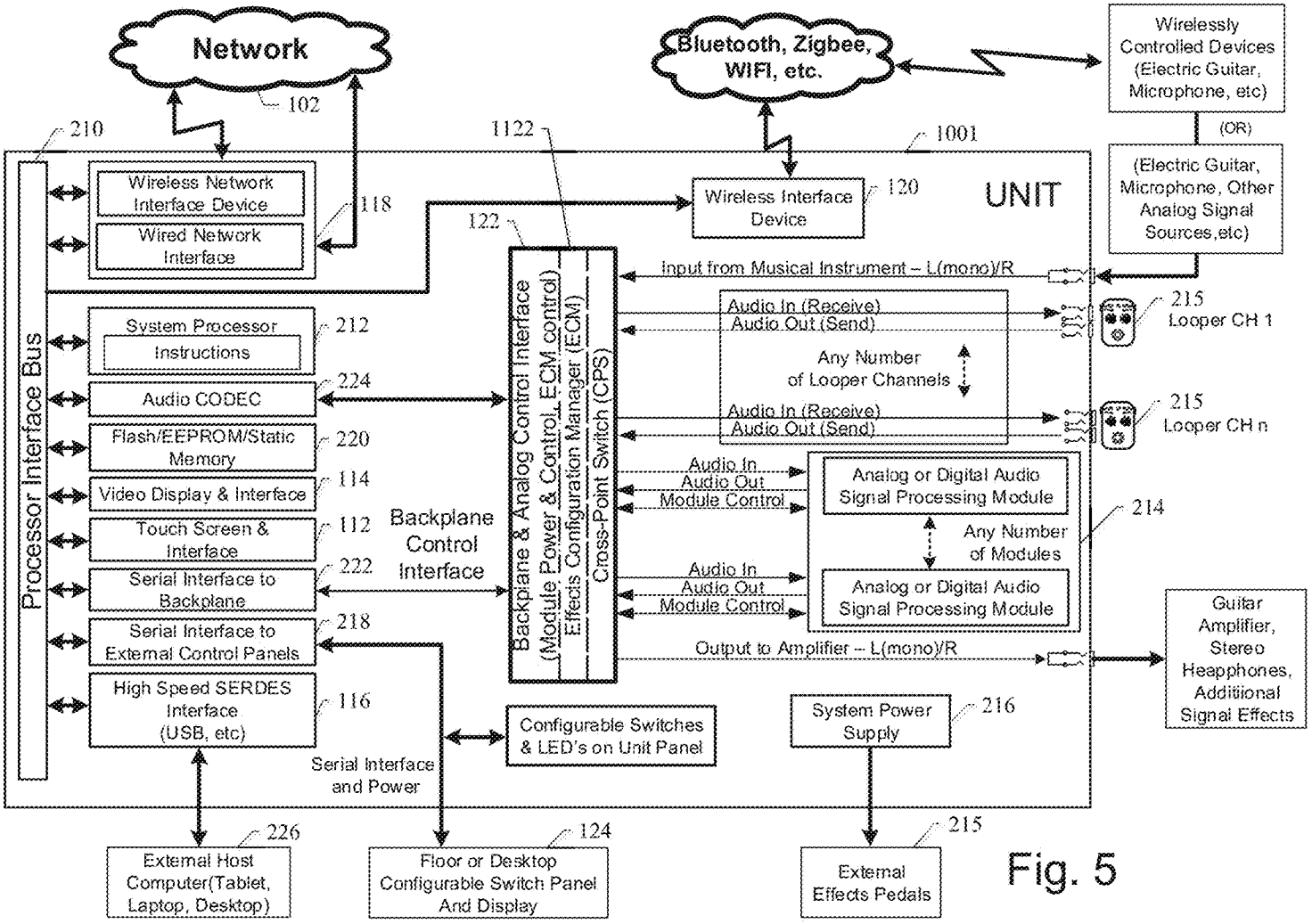
FIG. 5 illustrates an example embodiment of the platform or system for interfacing and controlling multiple musical instrument effects modules or pedals on a common platform.

FIG. 5 illustrates a more detailed example embodiment of a platform or system 1001 for interfacing and controlling multiple musical instrument effects modules 214 and pedals 215 on a common platform. FIG. 5 illustrates an example embodiment of the whole system 1001 also known as the unit 1001. As shown in FIG. 5, the main components of the system 1001 are the system processor 212 and instruction memory connected with a processor interface bus 210 and associated peripherals, a backplane 122 with interface components and connectors for interfacing any number of effects pedals 215, modules 214, a system power supply 216, a wireless interface 120 to control switches and potentiometers in guitars and microphones (or other local audio devices) not directly connected to the backplane 122, wired and/or wireless network interface 118 and an interface 218 for external CSP 124 with numerical or graphical displays. The system processor 212 executes programming instructions located in a non-volatile memory 220 on the system processor interface bus 210 to control all aspects of the system 1001 and its interfaces. The program is supported by an operating system such as Linux™ or Microsoft™ Windows™ but programs that are written to directly support the system 1001 components without the use of an operating system can also be used.

As also shown in FIG. 5, the various modules 214 that interface to the backplane 122 are controlled via interface drivers executed on the system processor 212. The translated protocol instructions or control signals for potentiometers 310 and switches 315 control are sent to the backplane 122 via interface 222. The module 214 interface drivers translate processor instructions received from the backplane interface 122 to a protocol specifically intended to adjust the digital potentiometers 310, switches 315, and any other related control elements of the modules 214 in a programmable manner.

Each pedal 215 and module 214 has an audio input signal interface and an audio output signal interface. The ordering of the pedals 215 and modules 214 to establish a signal path through the unit 1001 is configured by the CPS 822 as determined by the instructions sent to the ECM 1122 from system processor 212 via backplane interface 222. The analog input of the audio CODEC 224 controlled by system processor 212 can be connected to the analog output of any pedal 215 or module 214 through the CPS 822 to allow the system processor 212 to sample the analog signal via audio CODEC 224 to provide additional digital effects and to insert these digital effects at some point back into the signal path as determined by the user. The addition of streaming audio to the analog effects signal from sources, such as prerecorded music, for the musician to play along and practice are supported via the audio CODEC 224 and circuitry provided to combine (mix) the two analog signals. The backplane 122 and audio interface also provide the interconnections between the CPS 822 and the external effects pedal 215.

The CODEC 224 serves an additional purpose for testing an effects module 214 for both manufacturing test/calibration and player diagnostics. The system processor 212 has the capability to provide a software defined waveform at the CODEC 224 audio serial (for example $I^2S$) interface allowing the CODEC 224 to generate analog waveforms specific for module 214 testing. The system processor 212 has the capability to connect the input and output of a specific module 214 to the input and output of the CODEC 224. The system processor 212 set the potentiometers and switches in the selected module 214 to predetermined values, apply the specific analog waveform to that modules 214 input and digitally sample that modules 214 output at the CODEC 224, and use processing techniques in the system processor 212 to determine if the module 214 is performing as expected. Because the unit 1001 is an IoT device, a player has the capability to test a module 214 by selecting the test feature provided on the module 214 TSD 112/114 popup for testing over the internet. Because the unit 1001 is also the development platform for manufacturers of modules 214 for the unit 1001, this feature is also used for testing modules 214 in manufacturing.

The system processor 212 has numerous peripherals that are used together to control the audio signal processing modules 214 via the backplane 122, control the external CSP 124, control network communication on both internet and intranet, control a wireless interface 120 to configure signal processing modules 214 that are not directly connected to the backplane 122, and control the various system interfaces to the user. These peripherals controlled by the system processor 212 include a network interface device 118 (a network interface), a wireless interface 120 (wireless device control interface), an audio CODEC 224 with stereophonic capability, memory components 220 to store programming instructions and data (e.g., Flash, EEPROM, SRAM, etc.), a touch screen interface 112, a graphical display interface 114, a serial interface 222 to control the backplane 122, a serial interface 218 to control external CSP 124 and the high-speed serial interface bus 116 (computer interface) to interface with a local computer 226, such as a laptop or tablet. These serial interfaces can include, but are not limited to, SPI, I2C, UART, HDMI, RS-232 and MIDI.

The user configures the modules 214 by the touch screen interface 112 or an external computer 226 or a remote device connected to the base unit 1001 by either a wired or wireless network interface. Once the modules 214 are configured for a particular desired analog signal effect, the configuration can be stored with other configuration information in a file system in nonvolatile memory 220 by the system processor 212 and together these various configurations form a playlist. The configurations stored in the playlist can be recalled by the user via the touch screen interface 112 or the external CSP 124.

Musical Instrument Effects Module Description

Figure 6:
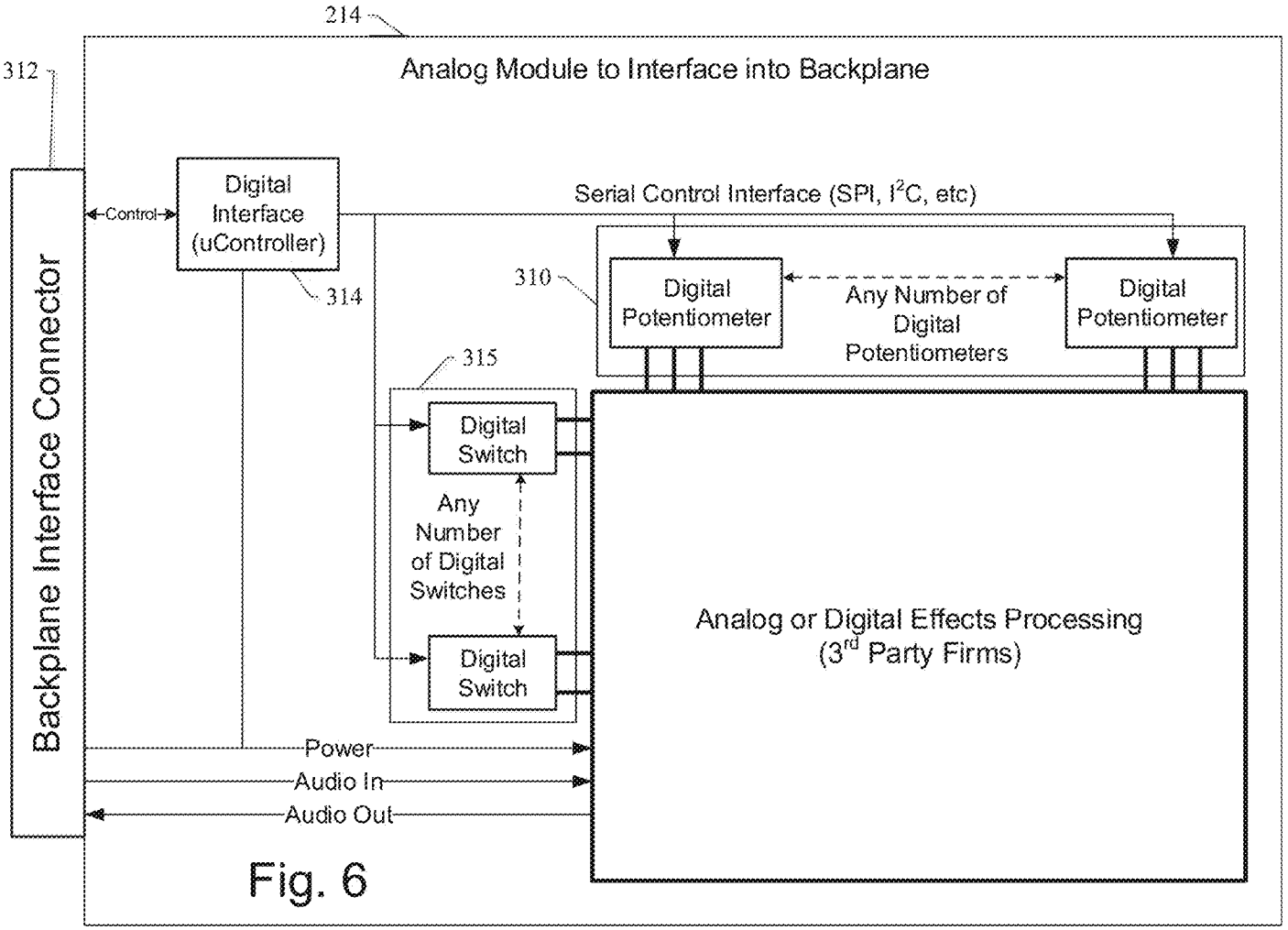
FIG. 6 illustrates a block diagram of an example embodiment of a typical effects module suitable for insertion and interfacing into the backplane of the unit.

FIG. 6 illustrates a block diagram of an example embodiment of a typical musical instrument effects module 214. The musical instrument effects modules 214 that contain the necessary electronics for signal processing are typically designed and built by firms that manufacture musical instrument effects pedals for the current market although they can be designed by any manufacturer. The manufacturers of products currently in the market will need to mechanically and electrically modify their products to adapt them to the system 1001. These modifications include, but are not limited to, replacing the mechanical potentiometers with their digitally-controlled equivalents 310, replacing the mechanical switches with their digitally-controlled equivalents 315, interfacing the analog signals to the backplane 122 through a common interface connector 312, adding necessary digital and analog interface components 314 such that the modules 214 signal conditioning electronics can be controlled through the backplane 122 interface connector 312. The modified musical instrument effects module 214 is then installed into an enclosure suitable for mechanical installation onto the backplane 122 by a third-party musician who has purchased the musical instrument effects module 214.

Note that one objective of system 1001 is to control the method that the musical instrument effects module 214 uses to alter the signal by controlling the potentiometers and switches through a digital interface rather than mechanical means. The digital interface 314 is typically a microcontroller with an embedded software driver that receives commands from system processor 212, but digital interface 314 could be any form of digital logic. The digital interface 314 processes those commands to determine which potentiometer or switch to set and the value or position to set it to. Digital interface 314 will then execute that command across modules 214 internal digital interface to adjust the target switch 315 or potentiometer 310 to the desired setting commanded by system processor 212. The backplane 122 provides mechanical and electrical connection from digital interface 314 on modules 214 to the Serial Interface controller 222 connected to the processor interface bus, which is under the control of the system processor 212, which is executing instructions from its main memory. The user configures the module 214 through the touch screen interface 112 via system processor 212 or an externally connected personal computer (e.g., laptop, tablet, etc.) 226 and controls the unit 1001 through these same devices or external control stomp box panel 124. Manufacturers may also choose to design a custom musical instrument effects module 214 that will interface to the backplane interface 122 with no equivalent effects pedal product currently on the market.

Backplane Interface

Figure 7:
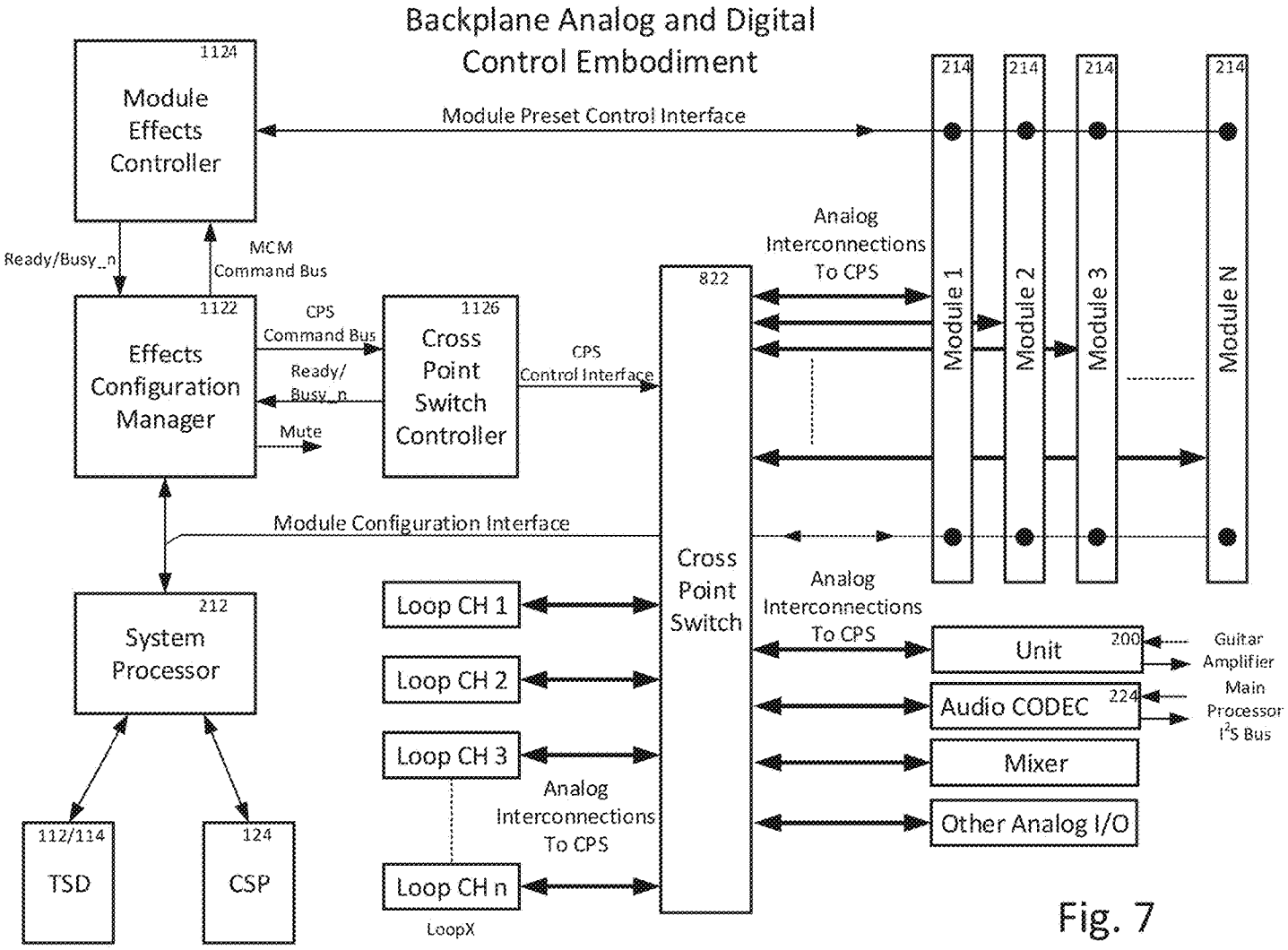
FIG. 7 illustrates the architecture and control of the analog interface of the effects modules and pedals.

FIG. 7 is an embodiment of the control and interface architecture of the backplane 122. As previously mentioned the backplane 122 consists of connectors and necessary interconnects to allow analog connections from pedals 215 and modules 214 to converge at the CPS 822. It also contains all the necessary control logic to support the interface protocols of the interconnected components. A detailed description of the interconnected component functionality and signal path configuration methodology of the backplane 122 is provided here.

At this point it is necessary to clarify the concept of a base configuration and a preset configuration. The simplest configuration for a song is its base configuration. Once a player has configured the unit 1001 signal path s/he has established a base configuration for a song. In the base configuration the only modifications a player can make to the signal paths settings is to bypass a pedal 215 or module 214 in the path or place a module 214 or pedal 215 in the active state. This is accomplished by stepping on a switch on the CSP 124 that is typically dedicated for a particular module 214 or pedal 215. It is possible to provide additional configurations in a song beyond the base configuration and the additional settings are called presets. These additional configurations can be called upon by hitting a footswitch for a particular effect such as one that might be required for a solo performance. Once the solo performance is complete hitting the foot switch again returns the unit 1001 to its previous configuration. The TSD 112/114 provides the primary interface for establishing a base configuration for module 214 as well as any pre-sets that extend the effects setting beyond the base configuration. Both base and preset configurations are communicated to module 214 over the digital interface 314 by either the MEC 1124 or the system processor 212 over backplane interface 122. The configuration of module 214 can be set to any number of predetermined configurations held in digital interface 314 memory that have been previously loaded for a particular song. When commanded by the MEC 1124 all modules 214 on the backplane can reconfigure themselves in parallel greatly reducing the time the system processor 212 would take to configure them one at a time.

There are three primary components of the backplane that control the configuration: The ECM 1122, MEC 1124 and CPSC 1126. The ECM 1122 receives a configuration command from the system processor that relates to module 214 and pedal 215 ordering to configure the signal path, and preset instructions that become a command to the MEC 1124. The ECM 1122 separates these two commands and sends the module 214 and pedal 215 re-ordering instruction (if any) to the CPSC 1126 and the preset configuration (if any) to the MEC 1124. The ECM 1122 can provide an instruction to the MEC 1124 or the CPSC 1126 or both. Prior to sending either command the ECM 1122 determines of the received instruction requires the unit 1001 analog output to be muted to avoid audible "pops" in the output to the amplifier. If so, the system mute signal is asserted.

When the MEC 1124 receives a command from the ECM 1122 it directs the modules 214 to change from their current configuration to the preset configuration instructed by the command from the ECM 1122. This is done over the Module Preset Control Interface shown in FIG. 7. All of the modules 214 assert a busy_n signal to inform the ECM 1122 to wait. As they complete reconfiguration they de-assert busy_n signal. Once the last module 214 to complete reconfiguration has finished a Ready Signal is sent to the MEC 1124 to be passed on to the ECM 1122.

In a like manner the CPSC 1126 receives a command from the ECM 1122 and instructs the CPS 822 to reorder the modules 214 and pedals 215, the CODEC 224 and other analog components connected to the CPS 822. This is done over the CPS Control Interface shown in FIG. 7. Once the re-ordering is complete a ready signal is asserted to the ECM 1122.

Once the ECM 1122 has detected a ready signal from both the MEC 1124 and the CPSC 1126, the ECM 1122 will wait for a period of time to allow the signal path to settle down before de-asserting mute.

Note that system processor 212 is connected directly to modules 214 via the MCI shown in FIG. 7. This interface allows entry of base and preset configurations into modules 214 from the TSD 112/114. When a player is in a module 214 menu, configuration of the module 214 potentiometers and switches occurs across this interface.

The representation depicted in FIG. 7 of the digital control architecture is configured to direct the analog effects setup in the unit 1001. As described earlier, the analog signal path is controlled by the CPS 822. As shown in FIG. 7, all analog effects input and output signals from both effects pedals 215 and modules 214 converge at the CPS 822 in addition to the analog CODEC 224, mixer and other analog components including the unit's 1001 analog input and output. The CPS 822 not only has a capability to reorder loop and module 214 channels, CPS 822 also has a capability to place loop and module 214 channels in parallel with each other forming a series-parallel effects processing capability.

After the unit 1001 has been configured to recognize the loops that have effects pedals 215 installed on them and designated modules 214 have been inserted into the unit 1001, the unit 1001 is ready for a player to configure it for analog effects. When a player wishes to set up an effect for a particular song, the setup is performed through the TSD 112/114. The steps performed to configure any particular effect can be performed in any order. The example presented here is one of many methods to achieve a given configuration.

One of the first steps a player might perform to establish a base configuration for a song would be to arrange the effects in a particular order. This would be accomplished by touching the icon of the first effect pedal 214 or module 214 in the signal path on the TSD 112/114 and dragging it to the location of the input of the signal path, the upper left corner of the display. When the player releases the effect icon, the system processor updates the signal path on the TSD 112/114 with the new location of the effect icon in the signal path, and sends a command to the ECM 1122 with the new effects order. The ECM 1122 sends a series of commands to the CPSC 1126 such that the CPSC 1126 can configure the CPS 822 to order the effects requested by the player. This sequence of transactions is repeated for every module 214 or effects pedal 215 the player drags and drops as the signal path is built. In the case where an effects icon is dropped on top of another effects icon, the two effects are placed in parallel by the CPS 822. In the case where an effects icon is dropped between two effects icons, the effects are placed in series between the two effects icons by the CPS 822. Any number of effects can be placed in series or parallel with this method.

Once the signal path of the effects has been established, the player can configure the state of the modules 214 and pedals 215. When the icon of a pedal 215 is touched, a pop up screen allows the module 214 to be placed in the bypass or active state. At the time the selection is made, a command from the system processor 212 is sent to the ECM 1122 to command the CPSC 1126 to place the pedal 215 effects loop in bypass or active by the CPS 822. Note that the pedal 215 itself is not commanded, there is no path to the pedal 215 to do so. The pedal 215 itself is always in an active state; bypass is performed by the CPS 822 by directing the input of the pedal 215 loop to the output. Once the state of the pedal 215 has been chosen, the pop up is closed. Touching the icon of a module 214 presents a pop up of a custom icon for the given module 214. Graphical elements on the pop up represent potentiometers 310 and switches 315 of the pedal 215 equivalent (assuming one exists). To adjust a potentiometer 310, the player touches the potentiometer 310 slide on the TSD 112/114 and slides his/her finger to the position that s/he wishes in much the same manner that s/he would turn a potentiometer for a desired effect. As s/he slides or releases his/her finger, the system processor senses the finger position and sends a command to the module 214 under control over the MCI. The module 214 interface receives the command and performs the adjustment to the potentiometer 310 in relation to the finger position on the TSD 112/114. In a similar fashion, other potentiometers 310 and switches 315 are configured over the MCI. Once the effects order, state and adjustments to potentiometers 310 and switches 315 is complete, the player has established the base configuration for a song. S/he may now save this base configuration to the system processors main memory with a title suitable for use in a playlist. S/he may also add presets to this base configuration, preset configurations useful for solo performances that can reconfigure modules 214 rapidly when called upon.

As stated earlier, presets are additional configurations for a song beyond the base configuration. Once a player has configured a song, prior to saving the song, s/he is provided the option to save additional sub-configurations with the song. These sub-configurations beyond the base setting settings are called presets. This section will describe how presets are processed by the backplane 122 logic. When a player is performing and wishes to invoke a preset, s/he does so by stepping on a pre-configured switch 920 on the CSP 124 that has been assigned the particular preset. A command for the particular preset is sent from the CPS 822 to the System Processor 212 and the System Processor 212 in turn sends a command to the ECM 1122 to execute the requested reconfiguration. This command consists of the signal path ordering of the effects pedals 215 and modules 214 for the preset configuration as well as the preset configuration for the modules 214. The ECM 1122 determines if muting the system to prevent an audible "pop" is necessary and if so the ECM 1122 performs the mute. The ECM 1122 then posts a command to the MEC 1124 to communicate the particular preset request to the modules 214 over the MPCI shown in FIG. 7. The ECM 1122 then posts a command to the CPSC 1126 to reorder the effects modules 214 and pedals 215 over the CPS Control Interface shown in FIG. 7. At this point, the ECM 1122 will wait until both the MEC 1124 and the CPSC 1126 have completed their tasks as indicated by assertion of their respective ready signals. If the ECM 1122 has asserted the Mute signal to the system, the ECM 1122 will wait an appropriate amount of time for the signal path to settle down from the changes to avoid and audible "pop" and de-assert the mute signal. After the system has been reconfigured to that requested by the player a signal is sent to the CPS 822 to illuminate an LED at the switch indicating the reconfiguration is complete. The time required for the reconfiguration should be quick enough such that no noticeable latency could be detected by a player of ordinary skill.

Switch Panel and Display

Figure 8:
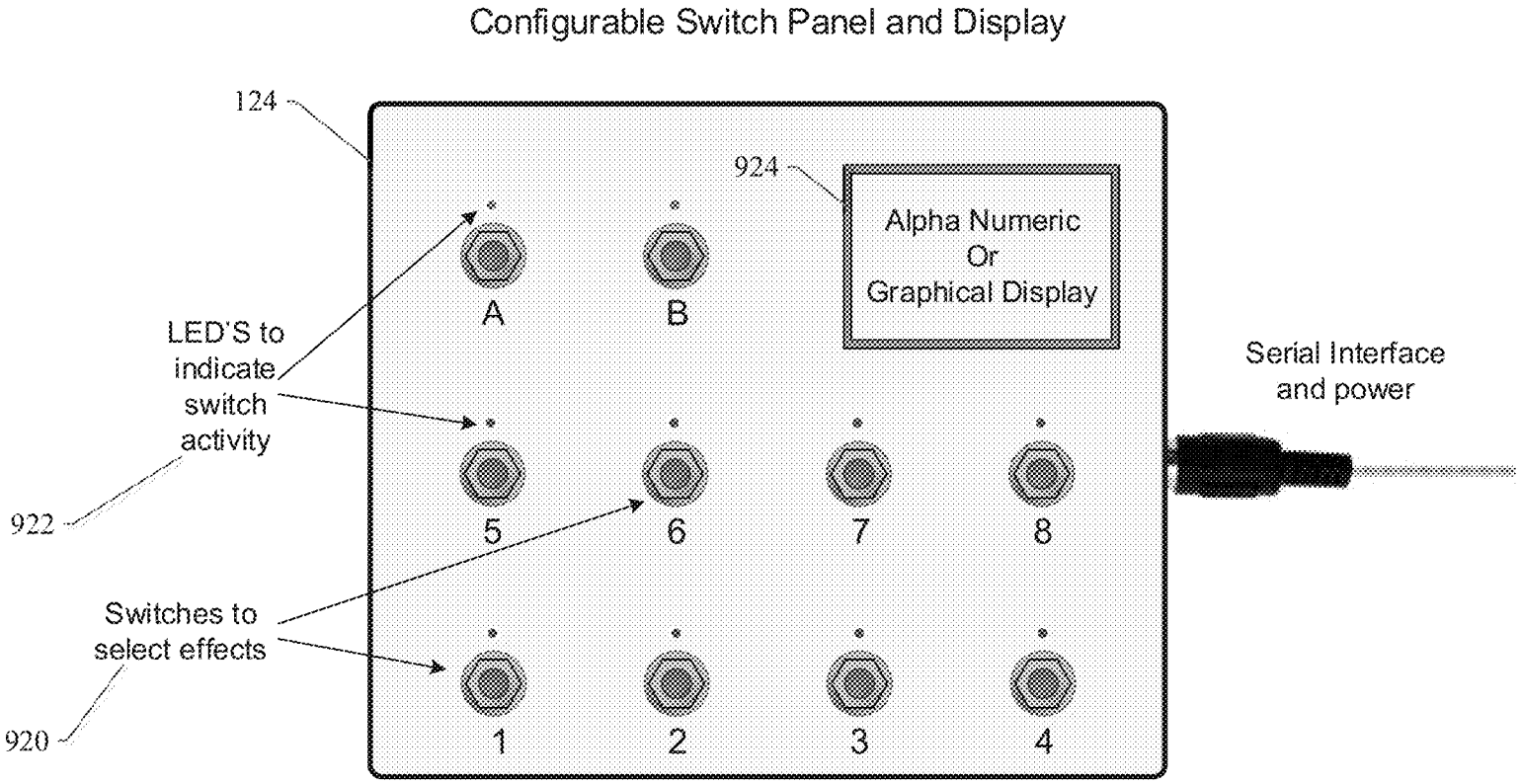
FIG. 8 depicts an example embodiment of a configurable switch panel as described herein.

FIG. 8 depicts an example embodiment of a CSP 124 as described above. The CSP 124 allows the user to control the system with the press of a foot switch 920 and for the panel to provide configuration feedback to the user with a graphical or numerical display 924 and LED's 922. In its most basic configuration, each switch 920 on the foot switch panel 124 behaves the same as a switch on a stomp box depicted in FIG. 1. In this configuration, a foot switch 920 is assigned to a particular module 214 or pedal 215 in the backplane 122 and is used to place the module 214 or pedal 215 into active or bypass mode. In more complex configurations, a switch 920 is used for actions such as changing the entire configuration of the system. This type of switch assignment flexibility is useful for tasks such as stepping through a playlist of configurations that are stored in the system processor's 212 file system or selecting particular preset during a performance. For example, switch A, shown in FIG. 8, could be used to change the configuration to the next song on the playlist and switch B could be used to change the configuration to the previous song on the playlist. All three songs (last, current & next) and other necessary information would be visible on the display 924 for immediate feedback to the user as to the current configuration of the system. The system processor 212 software allows for any conceivable configuration of the foot switches 920 on the panel 124 to support the user requirements and for display of any required information on the display 924. The LED's 922 typically present the status of the foot switch 920 position as either a feature is selected or not selected.

Figure 9:
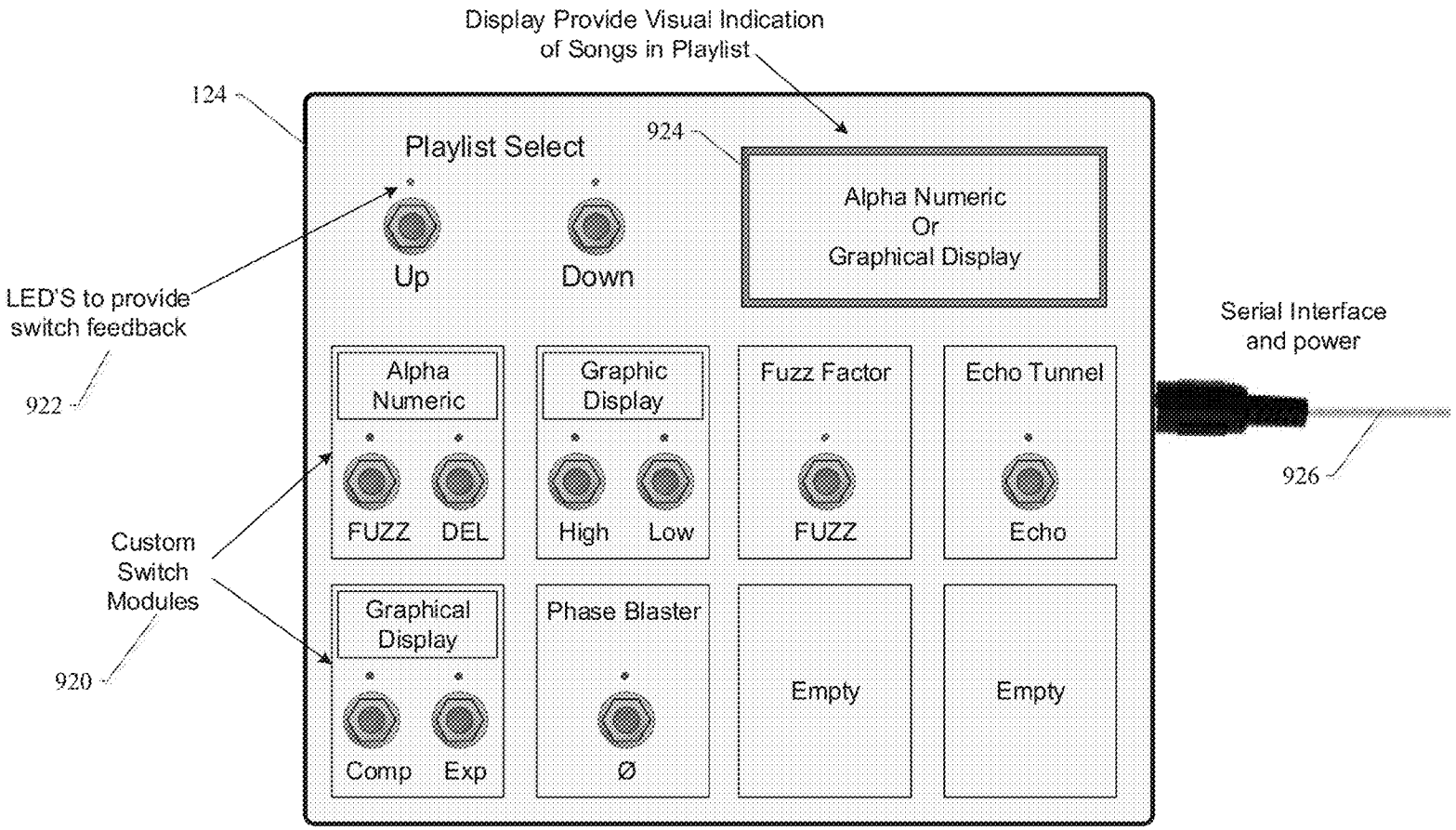
FIG. 9 illustrates a Custom Switch Panel and Display in an example embodiment.

FIG. 9 illustrates a CSP 124 in an example embodiment. This CSP 124 performs the same basic function as the embodiment depicted in FIG. 8, except the foot switches 920 are mounted onto modules 214 that are then mounted into a frame that mechanically and electrically accepts the custom switch module 920. The foot switch 920 modules 214 are designed and built by the manufacturers of the modules 214 and conform to an electrical interface standard of the CSP 124. The CSP 124 housing accepts foot switch 920 modules 214 that conform to a variety of physical sizes to accommodate foot switches of varying complexity while limiting wasted CSP 124 area. The electrical interface of a CSP 124 is through a connector that provides power and bi-directional control signals to a circuit board, which in turn connects the CSP 124 to the unit 1001, typically over a serial interface cable 926 but any interface including a wireless interface can be used.

Power to the switch panel and display 124 is provided over a cable with a connector interface 926 such as MIDI or common RS-232 cable or a wall mounted power supply. Communication with the system processor 212 is provided over the cable with the connector interface 926 such as MIDI or common RS-232 cable and could also be provided wirelessly. The CSP 124 contains necessary electronic circuitry and drivers required to support communication with the system processor 212, information presented to the display 924 and LED's 922, and detection of switch 920 closure.

User Interface

The virtual location of a module 214 or effects pedal 215 connected to a loop channel is its location with respect to its relative position in the effects processing order with the other modules 214 or effects loops. An effects loop assignment on the unit 1001 or a module 214 slot location in the backplane is the physical location for these components that become virtual locations once placement order has been assigned via the CPS 822. The physical placement is irrelevant to the virtual location, if a module 214 is relocated on the backplane its physical location will change but the system processor will still locate the effects module 214 properly in the virtual location when the player selects a song that requires that placement for a given effect.

Upon system power up the system processor will interrogate the system for the presence of effects modules 214 installed on the backplane and enumerate them accordingly. Their placement is cataloged in the systems processors memory for later use building virtual location configurations for an effect. The system processor is unable to determine the presence or absence of an effects pedal 215 connected to a loop channel so a configuration of what is installed externally around the periphery of the unit 1001 must be maintained manually by the player. The environment for configuring and effects pedal 215 is installed on one of any number of loops is described later below.

Configuring a Module

Figure 11:
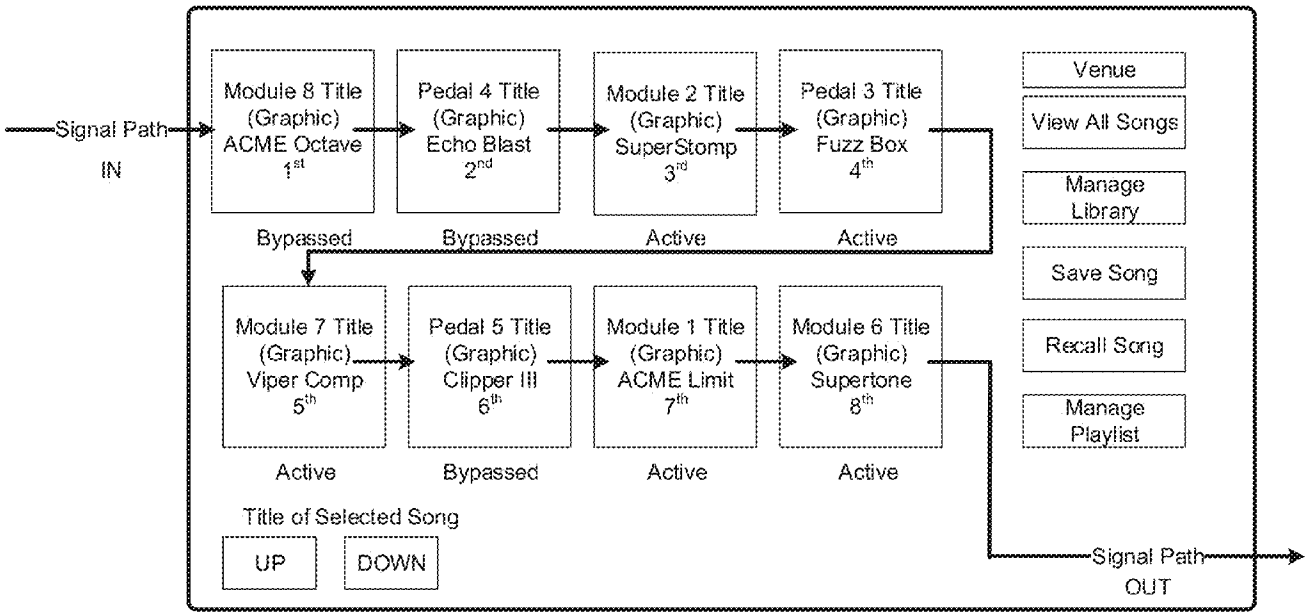
FIG. 11 illustrates an example embodiment including a menu for assigning module positions and an example configuration of modules and pedals in a backplane.

In an example embodiment with an analog backplane, the user can select the modules 214 to create the analog effects for their particular analog effects requirements and purchase these modules 214 from the various firms that manufacture products compatible with the system 1001. These modules 214 are then inserted into the backplane 122 in any order or any slot that the user desires. After the modules 214 are inserted and mechanically affixed with screws, fasteners, or any other means, the system 1001 is turned on. The system processor 212 will boot the operating system and a software application written to specifically support all the features of the system 1001 is invoked either automatically or manually with the touch screen interface 112. Once the application is launched, the backplane 122 is interrogated by the system processor 212 over the backplane control interface 222 for any installed modules 214 and their physical location in the backplane 122 is logged in main processor memory. For detected installed modules 214, corresponding module 214 drivers are loaded into the application interface for that module 214. If the application cannot find the module 214 driver in local memory, the application can access the Wide-Area Data Network (WAN) over the wireless (or wired) network interface 118 and locate the particular module 214 driver on the company website and download the module 214 driver over the internet. After the system processor 212 has determined the backplane 122 enumerations as described above is complete, the order of the modules 214 will be presented to the user on the graphical display 114 along with any options for user to select. FIG. 11 illustrates an example embodiment of the graphical information displayed to the user for a system with various modules 214 and pedals 215 populated in and around the unit 1001.

Figure 10:
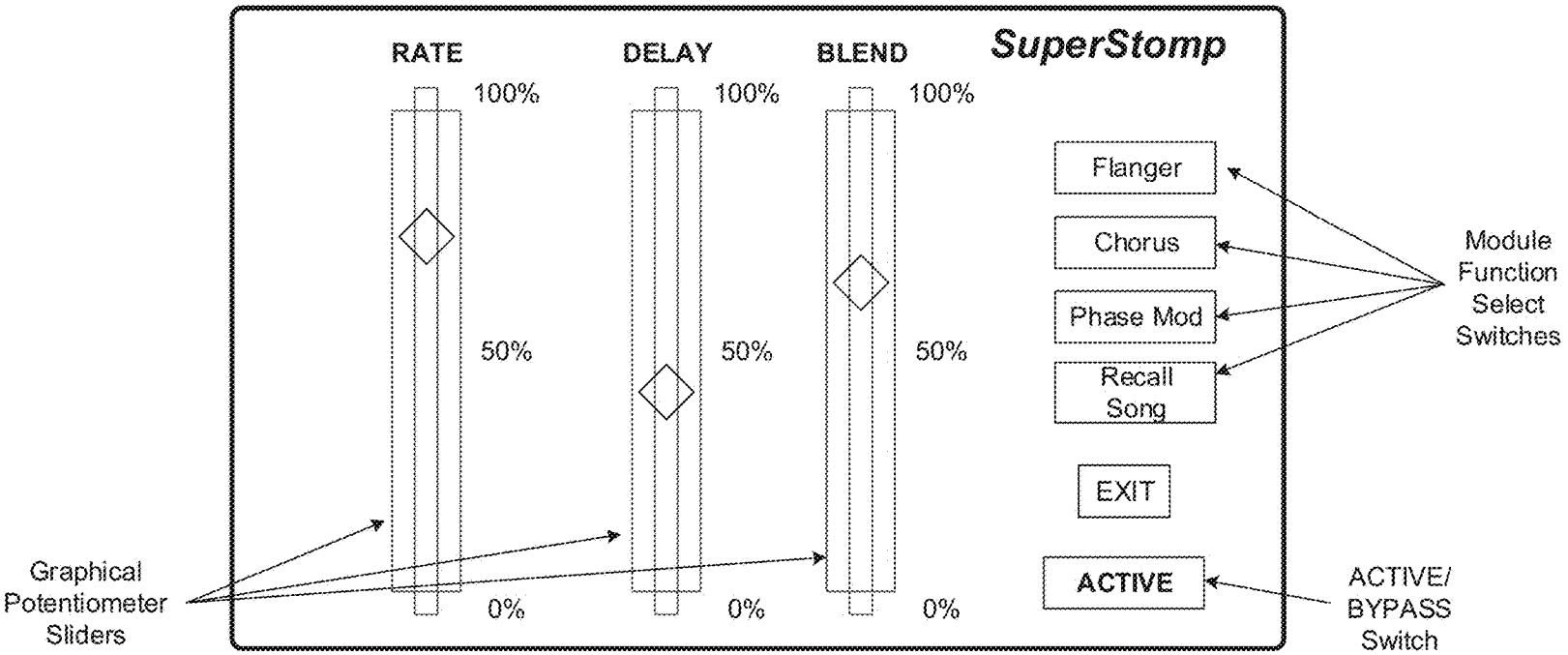
FIG. 10 illustrates an example embodiment including a graphical module interface on the graphical display in the example embodiment.

To configure a module 214, the user touches the graphical interface 114 at the location of the module 214 graphic and a sub-menu is displayed on the graphical interface 114. FIG. 10 illustrates an example of a modules 214 graphical interface on the graphical display 114 in an example embodiment. Using the user interface, the user can touch a potentiometer graphic on the display 114 and slide a finger to move the graphical position indicator causing the touch screen interface 112 to provide potentiometer 310 wiper positional information to the system processor 212. The system processor 212 then translates that positional information into a corresponding digital potentiometer 310 setting and sends a command to the digital potentiometer 310 on the module 214 selected on the sub menu via the backplane 122 interface to set that potentiometer 310 to the positional setting detected above. In a like manner, the configuration of the switches 315 select or deselect module 214 functions via the system processor 212 by touching the TSD 112/114 at the location of the switch graphic. The module 214 can be placed in the ACTIVE or BYPASS state with a graphical switch object located on the graphical display 114. Note that setting a module 214 to the active state from the touch screen 112 can be changed to BYPASS remotely by pressing the modules 214 switch 920 on the Configurable Switch Panel 124. Once the module 214 setup is complete, the user touches the EXIT switch, as shown in FIG. 10 to exit the module 214 menu and return to set up the remaining modules 214 and effects loops in a similar manner.

Configuring an Effects Loop

The unit 1001 provides for ¼" phone jack pairs for the purpose of connecting effects pedals 215. Each pair is connected to the CPS 822 by way of the backplane with the output of the effects pedal 215 driving the input of the CPS 822 and the output of the CPS 822 driving the input of the effects pedal 215. The most common output from an effects pedal 215 is monaural but some effects pedals 215 provide a stereo output and the unit 1001 will support such devices. In the most common implementation the effects pedal 215 will have potentiometers and switches to adjust the desired effect. With the effects pedal 215 connected to the analog input and output of the CPS 822 it is possible to insert the effect pedal 215 into the signal path and arrange the order of the effects pedal 215 in conjunction with the order of the effects modules 214 thus forming a hybrid arrangement of effects pedals 215 and modules 214. Some effects pedals 215 have a capability to change the effect settings over a serial interface such a MIDI or some other serial control interface. The unit 1001 has the capability to store settings (and presets described later) for the purpose of not only reordering the effects pedals 215 and modules 214 in the signal path but also adjusting the effects settings of those effects pedals 215 that have the serial interface capability.

To install an effects pedal 215 ¼" phone cords for analog input and output connections are required for connecting the effects pedal 215 to the unit 1001. Once a player has selected a loop channel to connect the effects pedals 215, s/he configures the main processing 212 system software to recognize the effect pedals' 215 presence on the system through a setup menu on the unit's 1001 TSD 112/114 so the pedal 215 can be registered on the system at that particular loop channel. A generic icon is instantiated on the TSD 112/114 as a visual reference for the effects pedal 215 and text entry on the TSD 112/114 allows the player to identity the effects pedal 215 by name. Because the unit 1001 is an IoT device, the player can use the unit 1001 to access the internet and request a custom icon for the effects pedal 215 at the pedal 215 manufacturers' home website. If the manufacturer does not support a custom icon for the product the player can chose from several generic icons provided by the unit 1001 and stored in the main processors 212 memory or access a third-party website and download from there.

Configuring a Preset

Once the effects signal path for a song has been configured it can be saved as a base configuration for a song. At the time the user will save the base setting s/he is presented with the option to create additional configurations to the base setting of the song. These additional setting are called presets and are useful for such things a solo performance which might have a different effect requirement than the base setting provides.

Once the player has selected to add a preset, s/he can change any of the base setting that s/he wishes. For example, the player can select a completely different set of modules 214 and pedals 215 for the signal path that those of the base configuration and configure them in any way that s/he may wish. Or it may be a simple modification of the base setting. Once the preset configuration setup is complete the player may then save the song, the base setting and the preset along with it. Upon saving the base configuration with the preset the player may be prompted to enter an additional preset and s/he may add a second if s/he wishes. In this manner the player may enter any number of presets up to the system limit should s/he desire. Also, songs consisting of only a base configuration and no presets may be retrieved at a later time for the purposes of adding preset configurations. Preset configurations are typically retrieved from system memory during a performance by hitting a switch on the CSP 124 but they may also be retrieved from the TSD 112/114 menu options.

The various example embodiments described herein can provide several benefits and advantages over the existing systems. Some of these beneficial system configurations include the following:

- A system that allows manufacturers of musical instrument effects pedals for the current market to adapt those products to a common platform for the purpose of reducing the quantity of wall mounted power supplies, interconnecting cables, switches, potentiometers and reducing weight and size.
- A system that allows a common interface for manufacturers of musical instrument effects pedals for the current market such that they are able configure and control the potentiometers and switches of those products from a touch screen interface rather than turning potentiometer knobs and toggling switches.
- A system that allows a common digital interface for manufacturers of analog musical instrument effects modules 214 for the current market such that they are able to save the configurations of their products in a file system so they can be recalled at a later time.
- A system that allows a common digital interface for manufacturers of analog musical instrument effects pedals for the current market such that they are able to recall the configurations of their products from a file system to enable rapid reconfiguring a system in a far shorter period of time with far greater repeatability than manual methods.
- A system that provides remote access to the musical instrument effects modules 214 as well as the system for the purpose of maintenance support, diagnostics and data collection.
- A system that can dynamically reorder the signal path through a collection of musical instrument effects pedal loops and modules 214 and also change the module 214 potentiometers and switch settings from a previously stored configuration in the system processors file system with the press of a single button. The reordering includes the virtual addition or removal of any module 214 or pedal 215 connected to the backplane.
- A system that allows setting the potentiometers and switches of an electric guitar over a wireless interface with a touch screen interface and saving those setting in the system processors memory for the purpose of a playlist.
- A system that allows changing the configuration of one or more musical instrument effects modules 214 and the attached electric guitars tone adjustment potentiometers and switches wirelessly from a previously stored configuration in the system processors file system with the touch of a single switch. Tone adjustment can include using a potentiometer in the guitar to adjust the battery voltage supply in the guitar to affect the tone.
- A system that provides power to effects pedals attached to looper channels for the purpose of providing a common system ground between the unit and the pedals, and eliminating the need for a power supply of power conditioner on the pedal board thus reducing cost, weight and associated area.

Figure 12:
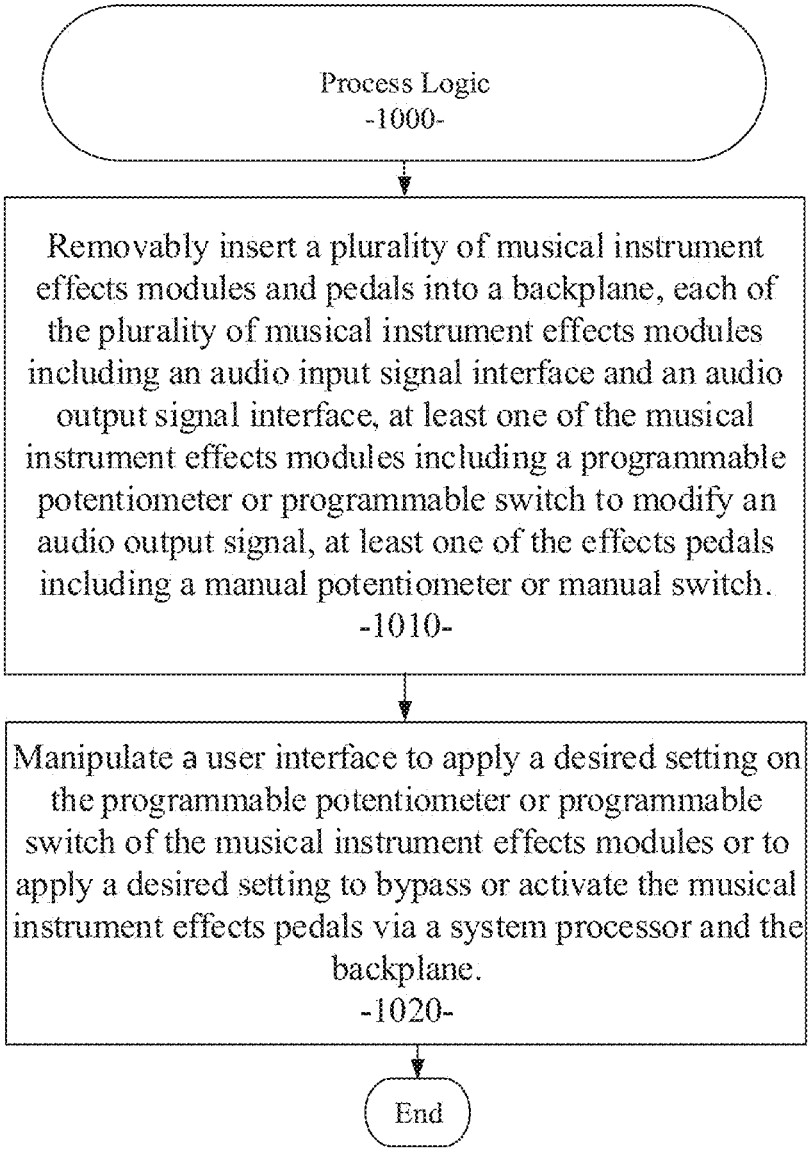
FIG. 12 is a flow chart illustrating a method for interfacing and controlling multiple musical instrument effects modules on a common platform, according to the embodiments as disclosed herein.

FIG. 12 is a flow chart illustrating a method for interfacing and controlling multiple musical instrument effects modules 214 on a common platform, according to the embodiments as disclosed herein. In an example embodiment, the method 1000 includes: removably inserting a plurality of musical instrument effects modules and pedals into a backplane, each of the plurality of musical instrument effects modules including an audio input signal interface and an audio output signal interface, at least one of the musical instrument effects modules including a programmable potentiometer or programmable switch to modify an audio output signal, at least one of the effects pedals including a manual potentiometer or manual switch (operation block 1010); and manipulating a user interface to apply a desired setting on the programmable potentiometer or programmable switch of the musical instrument effects modules or to apply a desired setting to bypass or activate the musical instrument effects pedals via a system processor and the backplane (operation block 1020).

Figure 13:
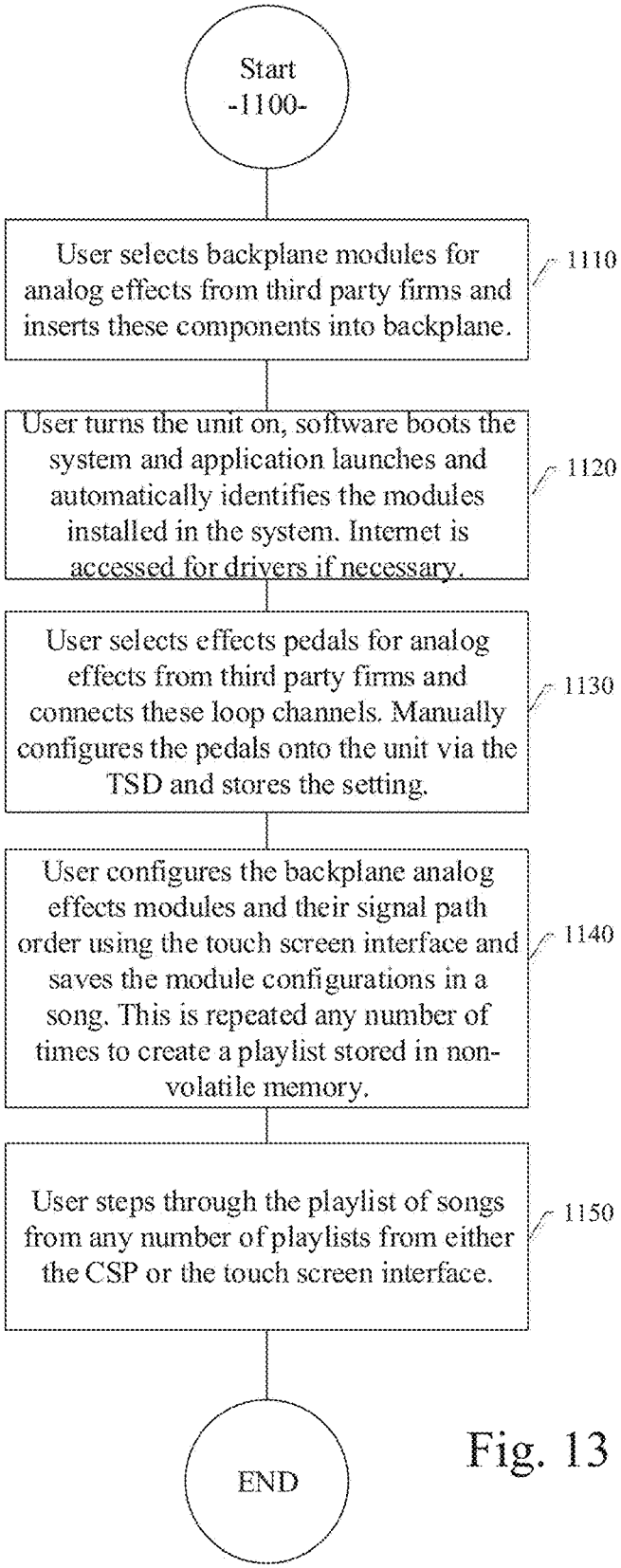
FIG. 13 is a flow chart illustrating another method for interfacing and controlling multiple musical instrument effects modules on a common platform, according to the embodiments as disclosed herein.

FIG. 13 is a flow chart illustrating another method for interfacing and controlling multiple musical instrument effects modules 214 on a common platform, according to the embodiments as disclosed herein. In an example embodiment, the method 1100 includes the following operations: A user selects the backplane 122 pedal modules 214 for analog effects from third party firms and inserts these components into the unit 1001 backplane 122 (operation block 1110); the user turns the unit 1001 on, the unit 1001 software boots, the system and application launches and automatically identifies the modules 214 installed in the system; the Internet is accessed for drivers if necessary (operation block 1120); User selects effects pedals 214 for analog effects from third party firms and connects these loop channels. Manually configures the pedals 214 onto the unit 1001 via the TSD 112/114 and stores the setting. (operation block 1130); the user configures the backplane 122 analog effects modules 214 one at a time using the touch screen 112 interface or remote computer 226 and saves the module 214 configurations for a song; this is repeated any number of times to create a playlist stored in non-volatile memory 220 (operation block 1140); and the user steps through the playlist of songs from any number of playlists from either the CSP 124 or the touch screen interface 112 (operation block 1150).

Figure 14:
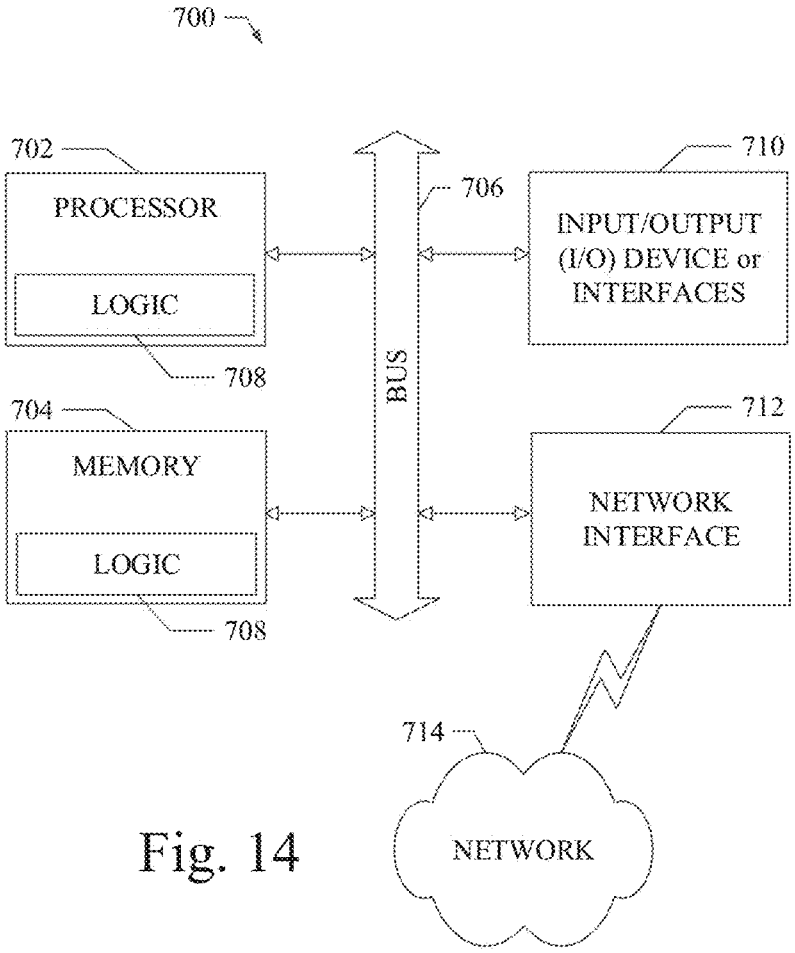
FIG. 14 shows a diagrammatic representation of machine in the example form of a computer system within which a set of instructions when executed may cause the machine to perform any one or more of the methodologies discussed herein.

FIG. 14 shows a diagrammatic representation of a machine in the example form of a stationary or mobile computing and/or communication system 700 within which a set of instructions when executed and/or processing logic when activated may cause the machine to perform any one or more of the methodologies described and/or claimed herein. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may operate with a personal computer (PC), a laptop computer, a tablet computing system, a Personal Digital Assistant (PDA), a cellular telephone, a smartphone, a web appliance, a set-top box (STB), a network router, switch or bridge, or any machine capable of executing a set of instructions (sequential or otherwise) or activating processing logic that specify actions to be taken by that machine. Further, while only a single machine is illustrated, the term "machine" can also be taken to include any collection of machines that individually or jointly execute a set (or multiple sets) of instructions or processing logic to perform any one or more of the methodologies described and/or claimed herein.

The example stationary or mobile computing and/or communication system 700 can include a data processor 702 (e.g., a System-on-a-Chip (SoC), general processing core, graphics core, and optionally other processing logic) and a memory 704, which can communicate with each other via a bus or other data transfer system 706. The mobile computing and/or communication system 700 may further include various input/output (I/O) devices and/or interfaces 710, such as a touchscreen display, an audio jack, a voice interface, and optionally a network interface 712. In an example embodiment, the network interface 712 can include one or more radio transceivers configured for compatibility with any one or more standard wireless and/or cellular protocols or access technologies (e.g., 2nd (2G), 2.5, 3rd (3G), 4th (4G) generation, and future generation radio access for cellular systems, Global System for Mobile communication (GSM), General Packet Radio Services (GPRS), Enhanced Data GSM Environment (EDGE), Wideband Code Division Multiple Access (WCDMA), LTE, CDMA2000, WLAN, Wireless Router (WR) mesh, and the like). Network interface 712 may also be configured for use with various other wired and/or wireless communication protocols, including TCP/IP, UDP, SIP, SMS, RTP, WAP, CDMA, TDMA, UMTS, UWB, WiFi, WiMax, Bluetooth™, IEEE 802.11x, and the like. In essence, network interface 712 may include or support virtually any wired and/or wireless communication and data processing mechanisms by which information/data may travel between a mobile computing and/or communication system 700 and another computing or communication system via network 714.

The memory 704 can represent a machine-readable medium on which is stored one or more sets of instructions, software, firmware, or other processing logic (e.g., logic 708) embodying any one or more of the methodologies or functions described and/or claimed herein. The logic 708, or a portion thereof, may also reside, completely or at least partially within the processor 702 during execution thereof by the mobile computing and/or communication system 700. As such, the memory 704 and the processor 702 may also constitute machine-readable media. The logic 708, or a portion thereof, may also be configured as processing logic or logic, at least a portion of which is partially implemented in hardware. The logic 708, or a portion thereof, may further be transmitted or received over a network 714 via the network interface 712. While the machine-readable medium of an example embodiment can be a single medium, the term "machine-readable medium" should be taken to include a single non-transitory medium or multiple non-transitory media (e.g., a centralized or distributed database, and/or associated caches and computing systems) that store the one or more sets of instructions. The term "machine-readable medium" can also be taken to include any non-transitory medium that is capable of storing, encoding or carrying a set of instructions for execution by the machine and that cause the machine to perform any one or more of the methodologies of the various embodiments, or that is capable of storing, encoding or carrying data structures utilized by or associated with such a set of instructions. The term "machine-readable medium" can accordingly be taken to include, but not be limited to, solid-state memories, optical media, and magnetic media.

It is to be understood that although various components are illustrated herein as separate entities, each illustrated component represents a collection of functionalities which can be implemented as software, hardware, firmware or any combination of these. Where a component is implemented as software, it can be implemented as a standalone program, but can also be implemented in other ways, for example as part of a larger program, as a plurality of separate programs, as a kernel loadable module, as one or more device drivers or as one or more statically or dynamically linked libraries.

As will be understood by those familiar with the art, the various embodiments described herein may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the various embodiments described herein or their features may have different names, divisions and/or formats.

Furthermore, as will be apparent to one of ordinary skill in the relevant art, the portions, modules, agents, managers, components, functions, procedures, actions, layers, features, attributes, methodologies and other aspects of the various embodiments described herein can be implemented as software, hardware, firmware or any combination of the three. Of course, wherever a component of the various embodiments described herein is implemented as software, the component can be implemented as a script, as a standalone program, as part of a larger program, as a plurality of separate scripts and/or programs, as a statically or dynamically linked library, as a kernel loadable module, as a device driver, and/or in every and any other way known now or in the future to those of skill in the art of computer programming. Additionally, the various embodiments described herein are in no way limited to implementation in any specific programming language, or for any specific operating system or environment.

Furthermore, it will be readily apparent to those of ordinary skill in the relevant art that where the various embodiments described herein are implemented in whole or in part in software, the software components thereof can be stored on computer readable media as computer program products. Any form of computer readable medium can be used in this context, such as magnetic or optical storage media. Additionally, software portions of the various embodiments described herein can be instantiated (for example as object code or executable images) within the memory of any programmable computing device.

As will be understood by those familiar with the art, the various embodiments described herein may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the various embodiments described herein or their features may have different names, divisions and/or formats. Accordingly, the disclosure of the various embodiments is intended to be illustrative, but not limiting, of the scope of the invention, which is set forth in the following claims.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A system comprising:

a system processor;

a touch screen display coupled with the system processor;

a backplane coupled with the system processor, the backplane to interface and control analog effects modules connected to the system;

a plurality of analog musical instrument effects pedals removably connected to the system with wired plugs, each of the plurality of analog musical instrument effects pedals including an audio input signal interface, an audio output signal interface, and a power connector; and a plurality of analog musical instrument effects modules removably inserted into the backplane, each of the plurality of analog musical instrument effects modules including an audio input signal interface, an audio output signal interface, and a digital interface, at least one of the plurality of analog musical instrument effects modules including a digitally programmable potentiometer or digitally programmable switch to modify an analog audio signal under control of the digital interface.

2. The system of claim 1 including an interface to a removable user configurable switch panel containing a plurality of foot switches, the configurable switch panel including at least one switch to enable or disable selection of any architecturally supported system feature.

3. The system of claim 1 including a wireless interface to remotely connect to a wired or wireless device containing a plurality of remote tactile feel devices including potentiometers, encoders, or switches.

4. The system of claim 1 including a control interface between the system processor and an analog cross-point switch (CPS) digitally controlled by the system processor, the CPS including an analog signal interface, wherein analog inputs and analog outputs of each of the plurality of analog musical instrument effects pedals or analog inputs and analog outputs of each of the plurality of analog musical instrument effects modules are connected to the CPS analog signal interface.

5. The system of claim 1 including a control interface between the system processor and each of the plurality of analog musical instrument effects modules for rapid analog effects reconfiguration from one of many alternative configurations (presets) as commanded by one or more instructions from the system processor, wherein the one or more instructions are executed by the digital interface on at least one of the modules.

6. The system of claim 1 including a plurality of foot switches and displays or LEDs, the functionality of the plurality of foot switches and displays or LEDs being configurable by a user via a graphical user interface.

7. The system of claim 1 including an external power interface to provide electrical power to effects pedals and other devices externally connected to the system.

8. The system of claim 1 wherein the system processor is further configured to utilize software defined waveforms and an analog CODEC, and to control the configuration of at least one of the modules, and apply one of the software defined waveforms to an input of the at least one of the plurality of analog musical instrument effects modules, and sample an output of the at least one of the plurality of analog musical instrument effects modules with the analog CODEC for diagnostic purposes.

9. The system of claim 1 including a CODEC wherein an analog input and an output of the CODEC are connected to an analog cross-point switch (CPS), and the analog CPS is controlled by the system processor.

10. A method comprising:

using a system processor, a touch screen display coupled with the system processor, a backplane coupled with the system processor, and a cross-point switch (CPS) coupled with the backplane, the backplane to interface and control analog effects modules connected to the backplane;

removably inserting a plurality of analog musical instrument effects modules into the backplane, each of the plurality of analog musical instrument effects modules including an audio input signal interface, an audio output signal interface, and a digital interface, at least one of the musical instrument effects modules including a digitally programmable potentiometer or digitally programmable switch to modify an analog audio signal under control of the digital interface;

removably connecting a plurality of analog musical instrument effects pedals to the CPS with wired plugs;

manipulating a graphical user interface of the touch screen display to configure the digitally programmable potentiometer or digitally programmable switch on the at least one of the musical instrument effects modules; and manipulating the graphical user interface of the touch screen display to reorder graphical user interface (GUI) icons corresponding to the plurality of analog musical instrument effects pedals and the plurality of analog musical instrument effects modules thereby causing a reordering of an analog effects signal path.

11. The method of claim 10 including attaching a removable user configurable switch panel to the system processor via a serial interface and manipulating at least one switch on the configurable switch panel to reconfigure at least one of the plurality of analog musical instrument effects modules or at least one of the plurality of analog musical instrument effects pedals.

12. The method of claim 10 wherein an input to output electrical ordering of the plurality of analog musical instrument effects modules or the plurality of analog musical instrument effects pedals is configured by dragging and dropping the GUI icons on the graphical user interface of the touch screen display, the dragging and dropping of the GUI icons causing the CPS to effect the configured ordering under control of the system processor.

13. The method of claim 12 wherein dragging and dropping a selected GUI icon between any two other GUI icons causes the two other GUI icons to move on the touch screen display creating room for the selected GUI icon between the two other GUI icons, the new positioning of the GUI icons on the touch screen display causing the system processor to command the CPS accordingly to electrically reorder the serial analog effects signal path in a manner corresponding to the new positioning of the GUI icons on the touch screen display.

14. The method of claim 12 wherein dragging and dropping a selected GUI icon on top of another GUI icon causes the selected GUI icon to appear above or below the other GUI icon on the touch screen display, the new positioning of the GUI icons on the touch screen display causing the system processor to command the CPS accordingly to electrically reorder the analog effects signal path from serial to parallel in a manner corresponding to the new positioning of the GUI icons on the touch screen display.

15. The method of claim 10 wherein a configuration GUI for an analog effects module remotely located on a remote system across the internet is downloaded and presented to a local user on the touch screen display, the configuration GUI causing the system processor to generate commands to configure the remotely located module to remotely process an analog signal captured by a local CODEC for remote analog effects processing across the internet.

16. The method of claim 15 wherein a remotely processed analog signal is sampled by a remote CODEC and returned to the local user for subsequent digital to analog conversion by a local CODEC and placed into the analog effects signal path.

17. The method of claim 10 wherein an analog effects module is configured for test by a remotely located system and a local CODEC is used to provide test waveforms provided by the remotely located system, the test waveforms being applied to the input of the locally configured module and the same local CODEC is used to sample the output of the locally configured module, the sample output subsequently analyzed by the remotely located system for calibration and diagnostics.

18. The method of claim 11 wherein a single foot switch activation on the configurable switch panel or a unit foot switch interface causes the system processor to either reorder the analog effects signal path, cause at least one of the plurality of analog musical instrument effects modules to alter their configuration to one of a plurality of predetermined configurations, or both.

19. The method of claim 10 including providing an external power interface to provide electrical power to effects pedals and other devices externally connected to the system.

20. The method of claim 10 including removably connecting an expression pedal to provide an analog voltage to an analog to digital converter or CODEC to sample an input analog voltage representative of a player's foot position on the expression pedal, the foot position to configure one or more programmable potentiometers or digitally programmable switches on a plurality of analog musical instrument effects modules.

21. The method of claim 10 including assigning a preset to a predetermined switch corresponding to a particular song, reconfiguring the plurality of analog musical instrument effects modules or the CPS when the predetermined switch is activated, and returning from the preset when the predetermined switch is activated again.

* * * * *